US008156880B2

(12) United States Patent
Vilnes

(10) Patent No.: US 8,156,880 B2
(45) Date of Patent: Apr. 17, 2012

(54) IMPACT ABSORBING DROP KEEL

(76) Inventor: Dag Vilnes, Husoysund (NO)

( * ) Notice: Subject to any disclaimer, the term of this patent is extended or adjusted under 35 U.S.C. 154(b) by 78 days.

(21) Appl. No.: 12/739,026

(22) PCT Filed: Oct. 30, 2008

(86) PCT No.: PCT/NO2008/000385

§ 371 (c)(1),
(2), (4) Date: Apr. 21, 2010

(87) PCT Pub. No.: WO2009/058026

PCT Pub. Date: May 7, 2009

(65) Prior Publication Data

US 2010/0218713 A1 Sep. 2, 2010

(30) Foreign Application Priority Data

Oct. 31, 2007 (NO) ..... 20075501

(51) Int. Cl.
*B63B 41/00* (2006.01)

(52) U.S. Cl. ..... 114/141; 114/140

(58) Field of Classification Search ..... 114/121, 114/122, 124, 126, 140, 141, 143
See application file for complete search history.

(56) References Cited

U.S. PATENT DOCUMENTS

| | | | | |
|---|---|---|---|---|
| 5,860,381 | A | 1/1999 | Fernandini | |
| 6,382,121 | B2 * | 5/2002 | Yu | 114/141 |
| 2007/0000422 | A1 | 1/2007 | Bianchi | |

FOREIGN PATENT DOCUMENTS

| | | | |
|---|---|---|---|
| DE | 3446844 | A1 | 7/1985 |
| EP | 0140758 | A1 | 5/1985 |
| GR | 1003522 | B1 | 1/2001 |

* cited by examiner

*Primary Examiner* — Lars A Olson
(74) *Attorney, Agent, or Firm* — David A. Guerra

(57) ABSTRACT

The present invention relates to a keel construction for a floating vessel, where a drop keel (3) can be adjusted from a retracted/extended position to an extended/retracted position for the purpose of varying the steering and gravity point of the floating vessel and through its construction also to be able to absorb impact in the event of a grounding with the drop keel (3). The drop keel (3) is connected with at least one around a fixed point extended and rotating element (7), where the extended and rotating element (7) is connected in the keel house (1) and further is connected with a fluid cylinder (6). An additional fluid cylinder (5) in the keel house (1) is connected to an upper end of the drop keel (3), which fluid cylinders (5, 6) can be controlled in order to readjust the drop keel (3) from a retracted position to an extended position (and vice versa) or to absorb the impact that the drop keel (3) is exposed to.

20 Claims, 2 Drawing Sheets

IMPACT ABSORBING DROP KEEL

CROSS-REFERENCE TO RELATED APPLICATIONS

This application is an U.S. national phase application under 35 U.S.C. §371 based upon co-pending International Application No. PCT/NO2008/000385 filed on Oct. 30, 2008. Additionally, this U.S. national phase application claims the benefit of priority of co-pending International Application No. PCT/NO2008/000385 filed on Oct. 30, 2008 and Norway Application No. 2007 5501 filed on Oct. 31, 2007. The entire disclosures of the prior applications are incorporated herein by reference. The international application was published on May 7, 2009 under Publication No. WO 2009/058026.

BACKGROUND OF THE INVENTION

1. Field of the Invention

The present invention relates to a keel construction for a floating vessel, where a drop keel can be adapted in order to vary the steering and the gravity centre of the vessel and simultaneously be able to absorb an impact by a stranding with the drop keel.

2. Description of the Prior Art

It is known that a sailing vessel must be built in order to meet the requirements for stability and steering. This could be done for instance by equipping the vessel with one or more keels.

SUMMARY OF THE INVENTION

An aim with the present invention is to provide a keel construction where the momentum that is obtained by the keel weight can be changed when increasing load on the floating vessel.

A further purpose with the present invention is to reduce strains on the keel hull during stranding with the drop keel.

Yet another purpose with the present invention is to provide a keel construction where the drop keel in a retracted position reduces the resistance in the water which the vessel is subjected to.

The present invention relates thus to a keel construction for a floating vessel, where the drop keel with a rotation can be adjusted from a retracted/extended position to an extended/retracted position.

A keel house is in a known way connected to the hull of a floating vessel and is fixed in such a way that the area around the fixation between the bottom of the hull of the vessel and the keel house is stiff. The keel house can have any form, but will as a basis be designed in order to give as little resistance as possible when the floating vessel is moving, where this for instance may be a drop shape or an oval form. At the rear edge of the keel house there is arranged on each side of the keel house a hinged or in other way fastened door, where the doors are opened when adjusting the drop keel. The drop keel is then brought from a retracted/extended position to an extended/retracted position. The doors will be locked when the drop keel is adjusted to the desired position, as this will give less resistance when moving the vessel. The doors can be controlled by cylinders that are connected to a central control unit in the vessel, or they can be arranged in other way to open or close the keel house.

In the keel house itself at least one extended element is arranged, where this element is used to bring the drop keel from a retracted/extended position to an extended/retracted position. This is achieved by that the extended element in its one end is being fastened to and rotary connected with the drop keel and in its other end through a bolt or the like being fastened to and rotary connected to the keel house. The bolt is in a preferred embodiment arranged transversal to the normal speed direction of the keel house (and the vessel), where the bolt thus forms a connection between the inner walls of the keel house. The extended element may further be connected with one or several fluid cylinders that are arranged in the keel house, where the cylinders are used to control and/or steer the position of the extended element. In addition the drop keel itself, where the drop keel comprises a keel fin and a keel weight is also connected to at least one actuating fluid cylinder, where the activation of this or these cylinders will result in the drop keel being brought out of a vertical position in the retracted position of the drop keel, while and activation of the cylinder that is connected to the extended element will result in that the drop keel is brought out of a vertical position in the extended position of the drop keel. When moving the vessel it can, for instance, be a need to lower the centre of gravity of the floating vessel, whereby one or the actuating fluid cylinders by means of a control unit is/are controlled, in such a way that the drop keel through the rotation of the extended element is brought to be adjusted from a retracted to an extended position outside the keel house.

In a preferred embodiment of the present invention an additional extended and rotating element will be arranged between the keel house and the drop keel, where both the support with the keel house and the drop keel will allow that the rotating element follows the motion of the drop keel by adjustment of the drop keel. This rotating element does not need to be connected to fluid cylinders.

The rotating elements, which can be massive and solid, are adapted based on weight and size of the vessel, length of keel etc.

Further, the rotating elements may on their insides that are the sides that face each other, in a retracted position of the drop keel, be arranged with complementary recesses. This will cause that the rotating elements in a extended position of the drop keel will be arranged partly covering each other, which will give a keel construction with greater strength and reduced resistance during the movement of the vessel.

The fluid cylinders that connect the rotating elements and/or the drop keel may, in an embodiment, be connected with a control and steering device, where this device will control the position of the cylinders thus allowing the drop keel to be adjusted from a retracted position to an extended position or also vice versa. The fluid cylinders may alternatively be connected to a device which by a manual operation allows the drop keel to be adjusted between the retracted and the extended position. The fluid cylinders must also be arranged in such a way that they in the event of a possible stranding with the drop keel absorb the impact, in such a way that the drop keel due to the sudden stop, is brought out of its position and is allowed to rotate from its extended position towards its retracted position, or also vice versa, whereby the keel hull (and also the drop keel) thereby is not exposed to these large forces and loads.

By the above adjustment of the drop keel, i.e. by adjustment from retracted to extended position or also vice versa, the movement of the lower part of the keel fin and the keel weight will indicate a semicircle. The impact due to the sudden stop is only absorbed in the first half of this semicircle, while in the other half of the semi-circle the movement of the drop keel will contribute with a force that will act in the moving direction of the vessel. The impact is absorbed by the fluid system of the cylinder.

The reduced load on the keel connection may for instance further allow for the introduction of a turntable which allows a rotational movement of the drop keel about an axis in the longitudinal direction of the drop keel.

BRIEF DESCRIPTION OF THE DRAWINGS

Further purposes, constructive embodiments and advantages of the present invention will be obvious from the following detailed description, the attached drawings and the following claims.

DETAILED DESCRIPTION OF THE INVENTION

Figure 2:
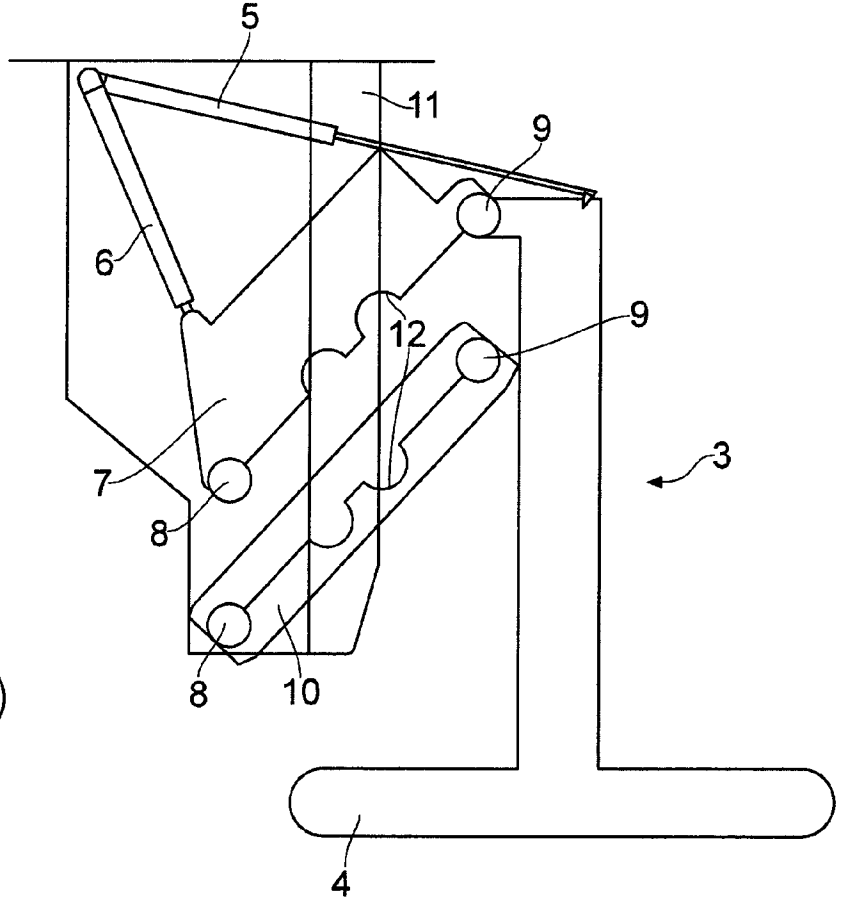
Figure 1:
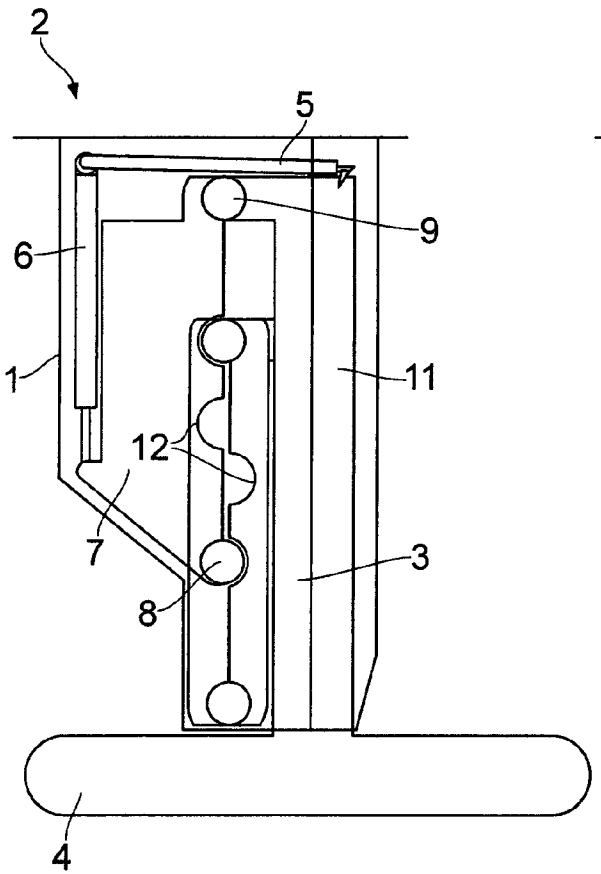
FIG. 1 show a cross section of the keel construction according to the present invention, where the drop keel is shown in a retracted or folded position partly arranged within a keel house, FIG. 2 show a cross section of the keel construction according to the present invention, where the drop keel is shown in an intermediate position outside the keel house, i.e. the drop keel is to be adjusted from the retracted or folded position in FIG. 1 and to an unfolded or extended position outside the keel house.

In FIGS. 1 and 2 a keel house 1 is shown, where this is connected to a bottom of a hull 2 on a floating vessel (not shown). The keel house 1 is stiffly attached to the bottom of the hull of the vessel 2. In the keel house 1 itself a drop keel 3 is arranged, where the drop keel 3 in a retracted or folded position is partly enclosed by the keel house 1. A weight 4 is arranged on the drop keel's (keel fin) lower end, where the weight 4 acts as a stabilizer for the floating vessel further.

The drop keel 3 in FIG. 1 is shown in a retracted or folded position (folded up), where only the weight 4 is situated outside the keel house 1. The drop keel 3 is in its upper end releasably connected to at least one fluid cylinder 5, where the fluid cylinder 5 in its other end is connected to the keel house 1, inside of this. The fluid cylinder 5 will further be arranged in such a way that it only controls approximately ¾ of the keel motion from a retracted or folded to an extended or unfolded position, as the fluid cylinder 5 will "drop" the drop keel after this distance. The fluid cylinder 5 will thereafter be retracted into the keel house 1 and on its way back the fluid cylinder 5 will, through suitable hook or gripping means (not shown) ensure that the doors 11 arranged on the rear edge of the keel house 1 are closed. The doors 11 will then be provided with corresponding hook or gripping means. What these hook or gripping means may be constituted of and how they are to be arranged on the fluid cylinder 5 and the doors 11 will be apparent for a skilled person in the art, and are thus not discussed further here.

Another fluid cylinder 6 is also shown, where this fluid cylinder 6 is connected to a first extended and rotating element 7. The first extended and rotating element 7 is on its one end arranged in a rotatable manner around a fixed point 8 in the keel house 1, where the fixed point 8 may be a bolt or a sleeve stretching across and through the keel house 1, when seen in the moving direction of the floating vessel. The other end of the first extended and rotating element 7 is connected to the drop keels 3 upper end through a connection point 9, where the connection point 9 between the drop keel 3 and the first extended and rotating element 7 allows a relative motion between these. The connection point 9 may be a bolt or a sleeve that is arranged either in the drop keel 3 or in the extended and rotating element 7. The fluid cylinder 6 is used in order to control the first extended and rotating elements 7 motion.

Another extended and rotating element 10 is in a similar way to the first extended and rotating element 7, arranged rotating around a fixed point 8 where this fixed point 8 is a bolt or a sleeve that stretches across and through the keel house 1, when seen in the moving direction of the floating vessel. The other end of the second extended and rotating element 10 is further connected with the drop keel 3 in a connection point 9.

The fixed points 8 for the first and second extended and rotating element 7, 10 are arranged to lay substantially vertically above each other.

The first and second extended and rotating elements 7, 10 are on theirs one long side formed with a number of recesses 12, which recesses 12 are arranged in such a way that they in a retracted or a extended position of the drop keel 1 will grip about the fixed point 8 and connection point 9. The first and second extended and rotating element 7, 10 are such formed that they partly are overlapping each other in the retracted or extended position of the drop keel 1.

The keel house also includes two doors or hatchways 11, where these are arranged hinged to the rear edge of the keel house 1. The hatchways 11 are arranged to be in a releasable contact with at least one fluid cylinder 5, where this or these fluid cylinders 5 are connected to a control and steering device (not shown) on board the floating vessel. This will result in that the hatchways 11 is opened when the drop keel 3 is to be brought to an unfolded or extended position outside the keel house 1, as shown in FIG. 3, and locked again when the drop keel is brought to the unfolded or extended position.

When the drop keel 3 is in its retracted or folded position, as shown in FIG. 1, the two extended and rotating elements 7, 10 will be arranged vertically and partly overlapping each other in the keel house 1, where the recesses 12 will grip about the fixed point 8 and connection point 9.

In FIG. 2 the drop keel 3 is about to be adjusted to an extended position as the fluid cylinder 5 has received a signal from the control and steering device, so that the piston rod has begun to extend. With this extension of the piston rod the first and second extended and rotating element 7, 10 will be displaced out of their vertical position when the drop keel 3 is in its retracted position, whereby the extended and rotating element 7, 10 have started to rotate about the fixed points 8.

Since the fluid cylinder 5 is in contact with the doors 11, the doors 11 will be opened at a certain extension of the piston rod of the fluid cylinder 5 and the drop keel 3 with the extended and rotating element 7, 10 will be brought outside the keel house 1. When the drop keel has moved about ¾ of the distance between the retracted and the extended position, the piston rod of the fluid cylinder 5 will "drop" the contact with the drop keel 3. The drop keel 3 will thereafter by its own force be swung down to the extended position. The piston rod in the fluid cylinder 5 will, when it has "dropped" the contact with the drop keel, be retracted into the keel house 1, whereby the piston rod on its way back will come in contact with the doors 1 and will thus, by means of the hook or gripping means, pull these with itself in order to close the keel house 1.

Figure 3:
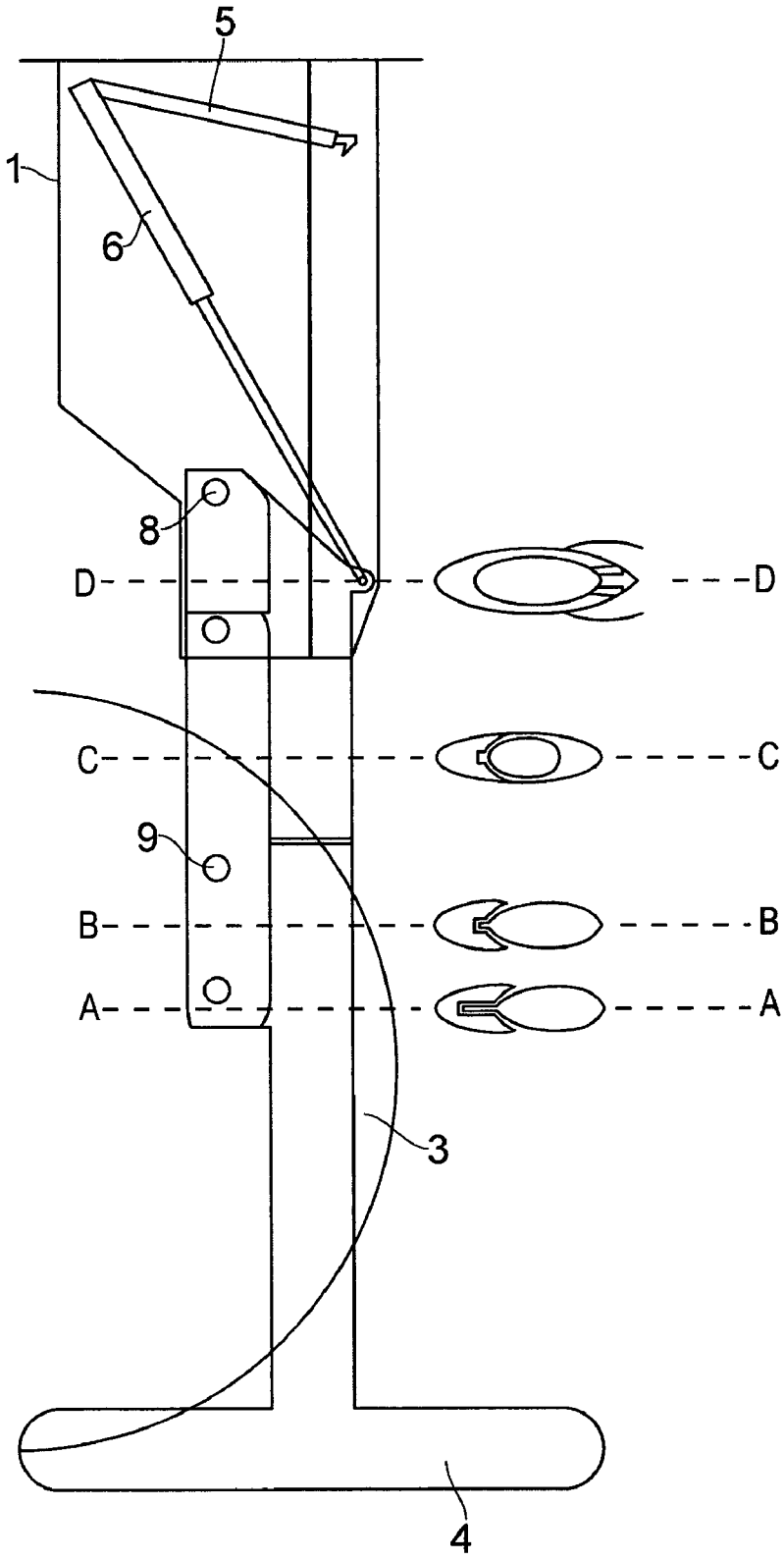
FIG. 3 shows a cross section of the keel construction according to the present invention, where the drop keel is shown in an unfolded or extended position outside the keel house.

The drop keel in FIG. 3 is shown in its extended position outside the keel house 1. Here, then, the extended and rotating elements 7, 10 will be arranged in a vertical position outside the keel house 1. The recesses 12 in the extended and rotating elements 7, 10 will then grip about the fixed point 8 and connection point 9. If the drop keel 3 is to be adjusted from the extended position to the retracted position, a signal will be sent from the control and steering device to the fluid cylinder 6, whereby the piston rod in the fluid cylinder 6 will be shortened. Due to the form of the extended and rotating element 7, the first and the second extended and rotating element 7, 10 will be displaced out of their vertical position and the drop keel 3 will then begin to be pulled up against the keel house 1. When the drop keel 3 has rotated and been drawn up about ¼ of the motion the drop keel creates between the retracted and the extended position, the fluid cylinder 5 will come in contact with the drop keel 3, whereby the last ¾ of the motion of the drop keel 3 will also be controlled by the fluid cylinder 5.

In the event of a grounding with the drop keel 3, where the drop keel 3 for instance is in its extended position, the control and steering device will through the fluid cylinder 6 register this as a sudden and severe change in the load, that the fluid cylinder 6 is exposed to, whereby the control and steering device will allow an immediate and gradual discharge of the fluid pressure in the fluid cylinder 6. This will allow the drop keel 3 to move against the floating vessels moving direction. The drop keel will also be "met" by the fluid cylinder 5, where this will function in the same way as the fluid cylinder 6. The fluid cylinders 5, 6 will only absorb the impact that the drop keel is exposed to in the half of the motion the drop keel 3 describes between a retracted and an extended position (or vice versa), as the drop keel 3 will contribute with a load acting in the moving direction of the floating vessel during the second half of the motion.

The invention claimed is:

1. A device for an impact absorbing folding keel for a floating vessel, the device comprising:

a drop keel is rotatable connected with at least two extended and rotating elements, which the two extended and rotating elements in a retracted position of the drop keel are arranged vertically and partly overlapping each other, where the extended and rotating elements from the retracted position to an extended position of the drop keel are rotated 180 degrees about a fixed point, in which extended position the extended and rotating elements are arranged vertically and partly overlapping each other partly outside a keel house.

2. The device according to claim 1, characterized in that the drop keel through a pivot point is connected with at least one about the fixed point of at least one of the extended and rotating elements, as the extended and rotating element further is connected to the keel house with at least one fluid cylinder.

3. The device according to claim 2, characterized in that the controllable fluid cylinder is connected to a control unit that which controls the fluid cylinder and adjusts overpressure in an event of the vessel running aground.

4. The device according to claim 1, characterized in that the drop keel is connected to the keel house through a controllable fluid cylinder, whereby the controllable fluid cylinder readjusts the drop keel from the retracted to the extended position and vice versa.

5. The device according to claim 1, characterized in that on each side of the keel house are arranged hinged doors, said doors being controllable.

6. The device according to claim 5, characterized in that the drop keel is rotatable around an axis in a longitudinal direction of the drop keel.

7. The device according to claim 1, characterized in that the keel house and a hull of the vessel are connected with a fixed connection.

8. The device according to claim 7, wherein the keel house and the hull being turned about an axis in a longitudinal direction of the keel house.

9. The device according to claim 1, wherein the extending and rotating elements each having at least on recess defined in a side thereof, the recess of a first of the extending and rotating elements being configured and located so as to receive therein the fixed point of a second of the extending and rotating elements when the drop keel is in the extended position.

10. The device according to claim 9, wherein the recess of the second extending and rotating element being configured and located so as to receive therein the pivot point of the first extending and rotating element when the drop keel is in the extended position.

11. The device according to claim 9, wherein the first and second extending and rotating elements each having an additional recess defined in the side thereof adjacent the recess respectively, the additional recess of the first extending and rotating element being configured and located so as to receive therein the pivot point of the second extending and rotating element when the drop keel is in the retracted position.

12. The device according to claim 11, wherein the additional recess of the second extending and rotating element being configured and located so as to receive therein the fixed point of the first extending and rotating element when the drop keel is in the retracted position.

13. A drop keel system comprising:

a first element pivotably connected to a keel house through a first element fixed point;

a second element pivotably connected to the keel house through a second element fixed point; and a drop keel rotatably connected to the first element through a first element pivot point, and rotatably connected to the second element through a second element pivot point, the second element pivot point being located between the first element pivot point and an end of the drop keel in a vertical axis;

wherein the first and second elements are arranged vertically and partly overlapping each other;

wherein from a retracted position to an extended position of the drop keel the first and second elements are rotated about the first and second element fixed points.

14. The drop keel system according to claim 13 further comprising a first controllable fluid cylinder connected to the first element and the keel house, the first controllable fluid cylinder being in communication with a control unit, the first controllable fluid cylinder performs one of readjusting the drop keel from the retracted to the extended position and vice versa, and absorbing an impact exposed to the drop keel.

15. The drop keel system according to claim 13 further comprising a second controllable fluid cylinder connected to the drop keel and the keel house, the second controllable fluid cylinder being in communication with a control unit, the second controllable fluid cylinder performs one of readjusting the drop keel from the retracted to the extended position and vice versa, and absorbing an impact exposed to the drop keel.

16. The drop keel system according to claim 13, wherein each side of the keel house is arranged a controllable hinged door, and wherein the drop keel further comprises a weight located the end of the drop keel.

17. The device according to claim 13, wherein the extending and rotating elements each having at least on recess defined in a side thereof, the recess of a first of the extending and rotating elements being configured and located so as to receive therein the fixed point of a second of the extending and rotating elements when the drop keel is in the extended position.

18. The device according to claim 17, wherein the recess of the second extending and rotating element being configured and located so as to receive therein the pivot point of the first extending and rotating element when the drop keel is in the extended position.

19. The device according to claim 17, wherein the first and second extending and rotating elements each having an additional recess defined in the side thereof adjacent the recess respectively, the additional recess of the first extending and rotating element being configured and located so as to receive therein the pivot point of the second extending and rotating element when the drop keel is in the retracted position.

20. The device according to claim 19, wherein the additional recess of the second extending and rotating element being configured and located so as to receive therein the fixed point of the first extending and rotating element when the drop keel is in the retracted position.

* * * * *